US009030368B2

(12) United States Patent
Chen et al.

(10) Patent No.: US 9,030,368 B2
(45) Date of Patent: May 12, 2015

(54) ANTENNA

(71) Applicant: Wistron NeWeb Corporation, Hsinchu (TW)

(72) Inventors: Chung-Hung Chen, Hsinchu (TW); Chih-Sen Hsieh, Hsinchu (TW); Chih-Ming Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 211 days.

(21) Appl. No.: 13/919,990

(22) Filed: Jun. 17, 2013

(65) Prior Publication Data

US 2014/0240190 A1 Aug. 28, 2014

(30) Foreign Application Priority Data

Feb. 27, 2013 (TW) ..... 102107051 A

(51) Int. Cl.
*H01Q 11/00* (2006.01)
*H01Q 5/00* (2006.01)

(52) U.S. Cl.
CPC ..... *H01Q 5/0027* (2013.01); *H01Q 5/307* (2015.01)

(58) Field of Classification Search
CPC ..... H01Q 1/243; H01Q 5/0027; H01Q 5/307
See application file for complete search history.

(56) References Cited

U.S. PATENT DOCUMENTS

| | | | | |
|---|---|---|---|---|
| 8,681,053 | B2 * | 3/2014 | Nagoshi et al. | 343/700 MS |
| 2008/0169981 | A1 * | 7/2008 | Hotta et al. | 343/700 MS |
| 2011/0043408 | A1 * | 2/2011 | Shi et al. | 343/700 MS |
| 2012/0105292 | A1 * | 5/2012 | Wong et al. | 343/749 |
| 2012/0176291 | A1 * | 7/2012 | Hsueh | 343/843 |
| 2012/0274517 | A1 * | 11/2012 | Nagoshi et al. | 343/700 MS |
| 2012/0293376 | A1 * | 11/2012 | Hung et al. | 343/702 |
| 2012/0299779 | A1 * | 11/2012 | Yen et al. | 343/700 MS |
| 2012/0299780 | A1 * | 11/2012 | Hsieh et al. | 343/700 MS |

* cited by examiner

*Primary Examiner* — Trinh Dinh
(74) *Attorney, Agent, or Firm* — Winston Hsu; Scott Margo

(57) ABSTRACT

An antenna for receiving radio signals of at least a first frequency band and a second frequency band includes a grounding unit for providing grounding, a connecting unit electrically connected to a first terminal of the grounding unit, a feeding terminal, formed on the connecting unit, for transmitting the radio signals of the first frequency band and the second frequency band, a first radiating element electrically connected between the connecting unit and a second terminal of the grounding unit, and a second radiating element electrically connected between the connecting unit and a third terminal of the grounding unit. Lengths of signal routes from the feeding terminal through the first radiating element and the second radiating element to the grounding unit are substantially equal to a half wavelength of the radio signals of the first frequency band and a half wavelength of the radio signals of the second frequency band, respectively.

13 Claims, 27 Drawing Sheets

ANTENNA

BACKGROUND OF THE INVENTION

1. Field of the Invention

The present invention relates to an antenna, and more particularly, to an antenna having flexible design for effectively adjusting radiation pattern or operating frequency band thereof.

2. Description of the Prior Art

Portable electronic products with wireless communication functionalities, e.g., laptops, tablet PCs, personal digital assistants (PDAs), etc., utilize antennas to emit and receive radio waves for transmitting or exchanging radio signals, so as to access wireless network. With the increasing demand for the appearance and functionalities of portable electronic products, available space for each component in a portable electronic product is getting compressed, so is the available space for an antenna device.

In addition, with the evolving of wireless communication technology, a single electronic product maybe equipped with multiple sets of antennas for supporting a Multi-input Multi-output (MIMO) communication technology or transmission requirements of multiple communication systems. When an electronic product is equipped with multiple sets of antennas within limited space, one of the fundamental communication requirements is to assure that these antennas have good isolation so that they are not affected with each other. Thus, it is a common goal in the industry to reduce coupling effects between these antennas. However, the antenna design becomes more difficult for improving the antenna isolation while the antennas are disposed in limited space.

On the other hand, if a housing of a portable electronic device is covered by metal, the antenna efficiency may be easily affected. In such a condition, if the antenna pattern can be adjusted more easily, the portable electronic device may be adapted to different application environments and the antenna efficiency may be increased.

Therefore, it is a common goal in the industry to design antennas which conform to transmission requirements and have adjustable radiation patterns or operating frequency bands, while taking the size and functions into account at the same time.

SUMMARY OF THE INVENTION

It is therefore an objective of the present invention to provide an antenna having flexible design and adapting to different applications with enhanced or increased antenna efficiency.

An embodiment of the present invention discloses an antenna for transmitting and receiving radio signals of at least a first frequency band and a second frequency band. The antenna includes a grounding unit, for providing grounding; a connecting unit, electrically connected to a first terminal of the grounding unit; a feeding terminal, formed on the connecting unit, for transmitting the radio signals of the first frequency band and the second frequency band; a first radiating element, electrically connected to the connecting unit and a second terminal of the grounding unit, wherein a length of a signal path from the feeding terminal through the connecting unit and the first radiating element to the grounding unit is substantially equal to a half wavelength of radio signals at the first frequency band, to form the first radiating element used for transmitting and receiving the radio signals of the first frequency band; and a second radiating element, electrically connected to the connecting unit and a third terminal of the grounding unit, wherein a length of a signal path from the feeding terminal through the connecting unit and the second radiating element to the third terminal of the grounding unit is substantially equal to a half wavelength of radio signals at the second frequency band, to form the second radiating element used for transmitting and receiving the radio signals of the second frequency band.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
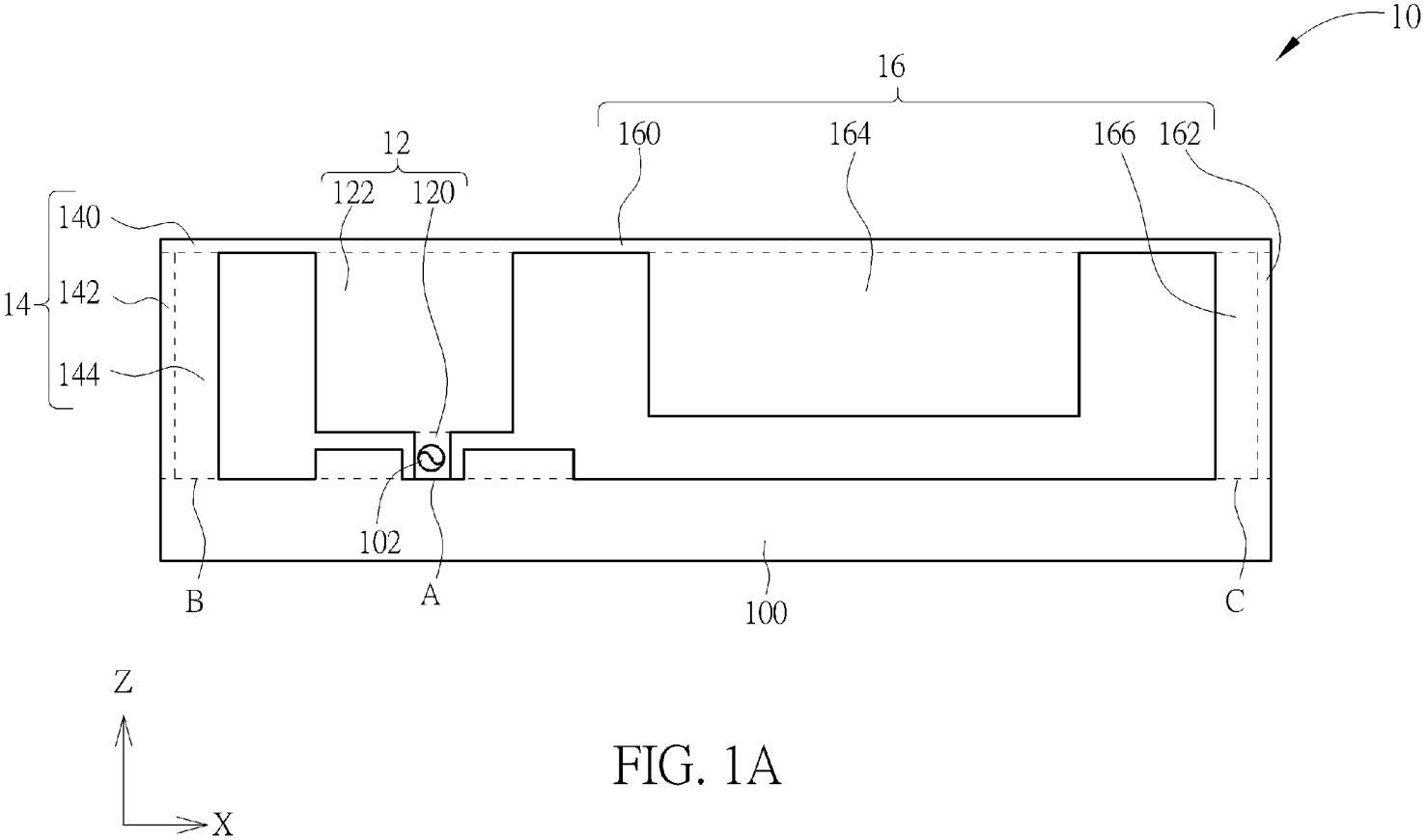
FIG. 1A is a schematic diagram of a front view of an antenna according to an embodiment of the present invention.
Figure 1B:
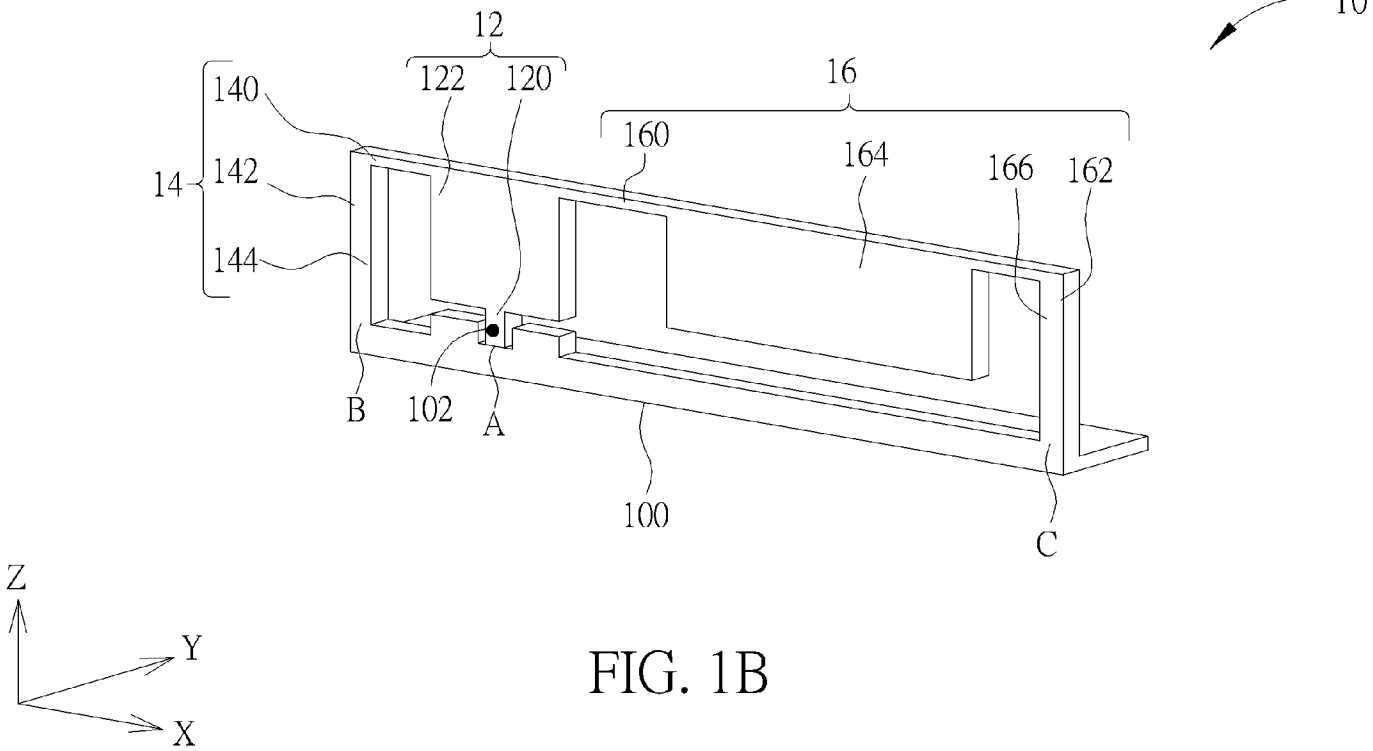
FIG. 1B is a schematic diagram of a three-dimensional view of the antenna shown in FIG. 1A.

Please refer to FIGS. 1A and 1B, which are schematic diagrams of a front view (x and z axes) and a three-dimensional view (x, y and z axes) of an antenna 10 according to an embodiment of the present invention, respectively. The antenna 10 may transmit and receive radio signals with multiple bands and have good radiation efficiency, and the radiation pattern thereof is easy to be adjusted. Hereinafter, a radio signal RF_1 at a first frequency band and a radio signal RF_2 at a second frequency band (e.g. radio signals at 5 GHz and 2.4 GHz) are transmitted and received by the antenna 10 as an example for simplifying the illustration. Those skilled in the art may make alterations and modifications accordingly for applying to multi-band or wide-band operations. In detail, the antenna 10 is made of a conductive material (e.g., metal such as iron, copper), and includes a grounding unit 100, a feeding terminal 102, a connecting unit 12, a first radiating element 14 and a second radiating element 16. The grounding unit 100 is used for providing grounding. The connecting unit 12 is electrically connected to a first terminal (denoted by A) of the grounding unit 100, and may be viewed as composing of a first block 120 and a second block 122, wherein the feeding terminal 102 is formed on the first block 120 for transmitting radio signals. The first radiating element 14 is electrically connected to the second block 122 of the connecting unit 12, and is extended to a second terminal (denoted by B) of the grounding unit 100. A length of a signal path from the feeding terminal 102 through the connecting unit 12 and the first radiating element 14 to the second terminal B of the grounding unit 100 is substantially equal to a half wavelength of the radio signal RF_1 at the first frequency band, in order to form a first radiating element used for transmitting and receiving the radio signal RF_1 at the first frequency band. Similarly, the second radiating element 16 is electrically connected to the second block 122 of the connecting unit 12, and is extended to a third terminal (denoted by C) of the grounding unit 100. A length of a signal path from the feeding terminal 102 through the connecting unit 12 and the second radiating element 16 to the third terminal C of the grounding unit 100 is substantially equal to a half wavelength of the radio signal RF_2 at the second frequency band, in order to form a second radiating element used for transmitting and receiving the radio signal RF_2 at the second frequency band.

In short, the antenna 10 reaches dual-band transmission via groundings at two sides of the feeding terminal 102 (i.e. terminals B, C). In addition, parasitic blocks on the first radiating element 14 and the second radiating element 16 may be used to adjust the radiation pattern or the operating frequency bands of the antenna 10, and to control isolation if multiple antennas 10 are juxtaposed. In detail, the first radiating element 14 includes a first branch 140, a second branch 142 and a parasitic block 144. The first branch 140 is substantially perpendicular to the second branch 142. The parasitic block 144 is extended from the second branch 142 toward the connecting unit 12, and is connected with the first branch 140 and the second terminal B of the grounding unit 100. Similarly, the second radiating element 16 includes a third branch 160, a fourth branch 162 and parasitic blocks 164, 166. The third branch 160 is substantially perpendicular to the fourth branch 162. The parasitic block 164 is extended from the third branch 160 toward the grounding unit 100. The parasitic block 166 is extended from the fourth branch 162 toward the connecting unit 12, and is connected with the third branch 160 and the third terminal C of the grounding unit 100.

Figure 2A:
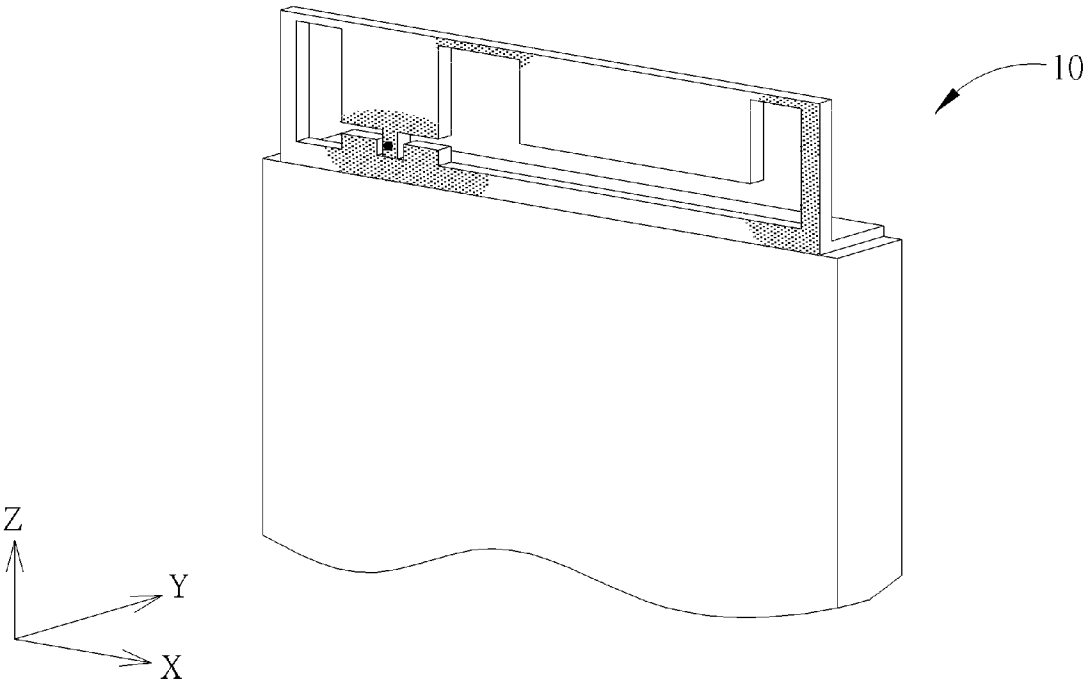
FIG. 2A is a schematic diagram of current distribution when the antenna shown in FIG. 1A operates at a high frequency band.
Figure 2B:
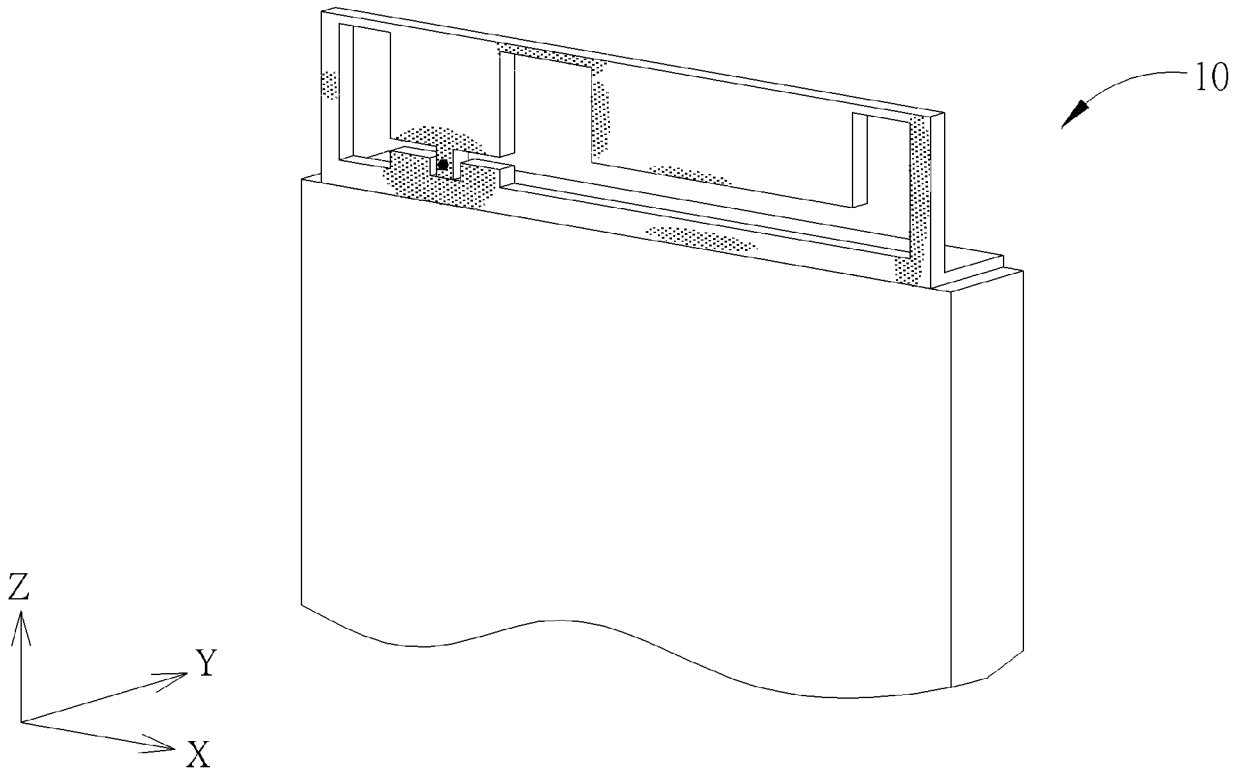
FIG. 2B is a schematic diagram of current distribution when the antenna shown in FIG. 1A operates at a low frequency band.
Figure 2C:
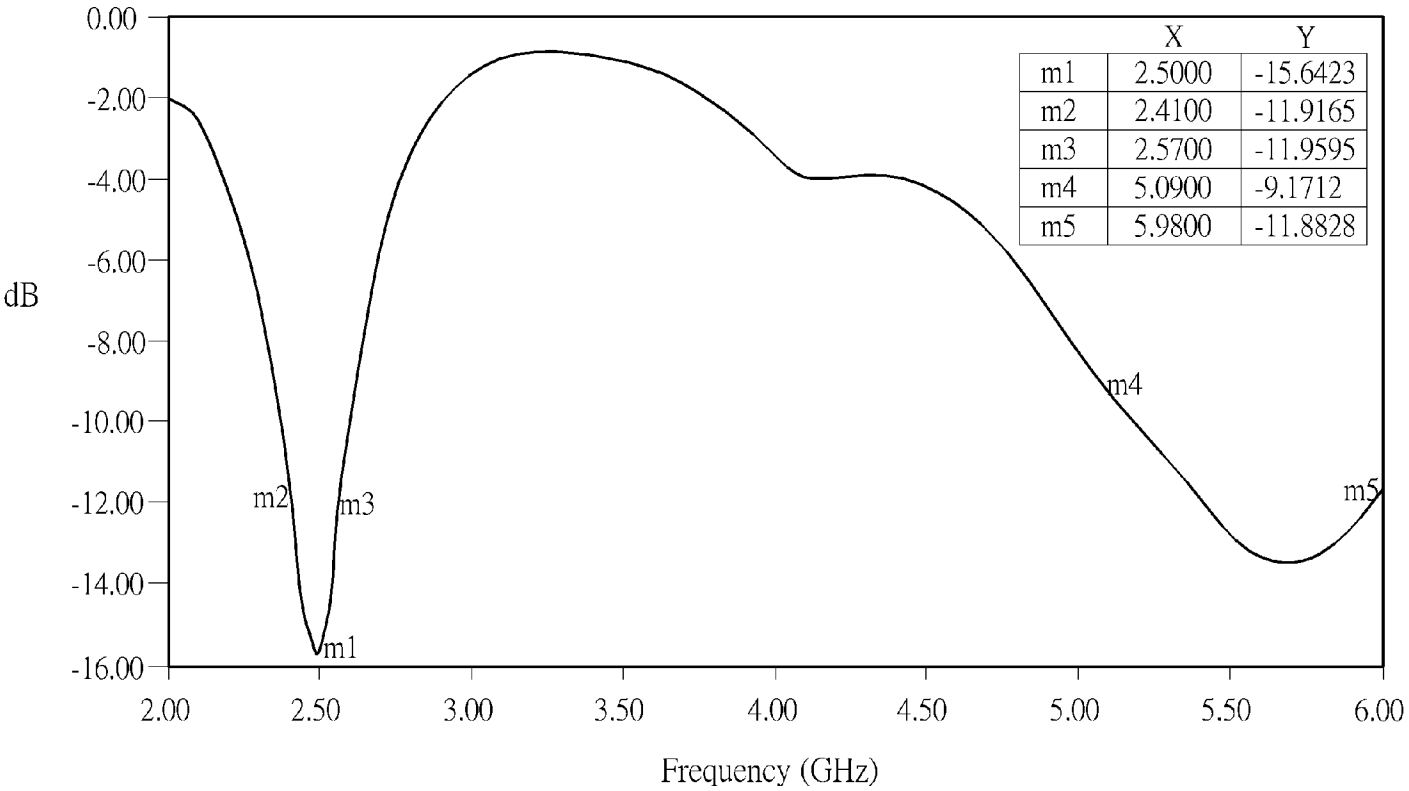
FIG. 2C is a schematic diagram of return loss of the antenna shown in FIG. 1A.

The parasitic blocks 144, 164 and 166 may be used to adjust or change current distribution of the antenna 10, so as to change the operating frequency bands or the radiation pattern of the antenna 10. Please refer to FIGS. 2A, 2B and 2C. FIGS. 2A and 2B are schematic diagrams of current distribution when the antenna 10 operates at a high frequency band (e.g. radio signal RF_1 transmitted and received at the first frequency band) and at a low frequency band (e.g. radio signal RF_2 transmitted and received at the second frequency band), respectively. FIG. 2C is a schematic diagram of return loss of the antenna 10 applied at 2.4 GHz and 5 GHz. As mentioned previously, the length of the signal path from the feeding terminal 102 through the connecting unit 12 and the first radiating element 14 to the second terminal B of the grounding unit 100 is substantially equal to a half wavelength of the radio signal RF_1 at the first frequency band; therefore, when the antenna 10 transmits and receives the radio signal RF_1 at the first frequency band through the first radiating element 14, an excitation point is formed at a location which is three-quarters of wavelength (of the radio signal RF_1) away from the feeding terminal 102, so as to correctly transmit and receive the radio signal RF_1 at the first frequency band. The second radiating element 16 also operates in a similar manner. In such a condition, the return loss diagram shown in FIG. 2C may be obtained by adaptively adjusting the lengths of the first radiating element 14 and the second radiating element 16 and the dimensions of the parasitic blocks 144, 164 and 166. Thus, the antenna 10 may achieve dual-band operation.

Note that, FIGS. 1A and 1B illustrate feasible embodiments of the present invention, and those skilled in the art can make modifications and alterations accordingly. For example, the parasitic blocks 144, 164 and 166 included in the first radiating element 14 and the second radiating element 16 are utilized for adjusting the current distribution. Therefore, the number and the style of the parasitic blocks are not limited to the examples shown in FIGS. 1A and 1B, and may be appropriately adjusted depending on different application requirements. Furthermore, the lengths of the first radiating element 14 and the second radiating element 16 are related to the frequency bands of transmitted and received radio signals, and may be appropriately adjusted depending on the above-mentioned conditions (a half wavelength) and different system requirements.

Besides, since the parasitic blocks 144, 164 and 166 may be used to adjust the operating frequency bands or the radiation pattern of the antenna 10, flexibility of design and application is therefore reached. For example, the radiation pattern of the antenna 10 in an electronic device with metal housing maybe changed by adjusting the dimensions of the parasitic blocks 144, 164 and 166, so as to achieve optimum radiation efficiency under the metal housing. Moreover, for applications of MIMO or multiple sets of antennas, the parasitic blocks 144, 164 and 166 may be utilized to increase the isolation between different antennas.

Figure 3A:
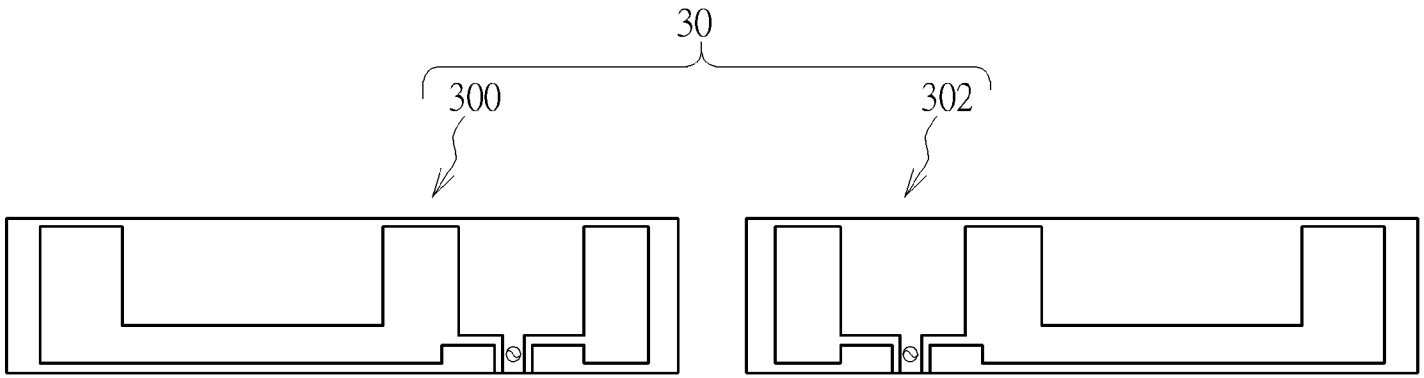
FIG. 3A is a schematic diagram of a front view of an antenna system according to an embodiment of the present invention.
Figure 3B:
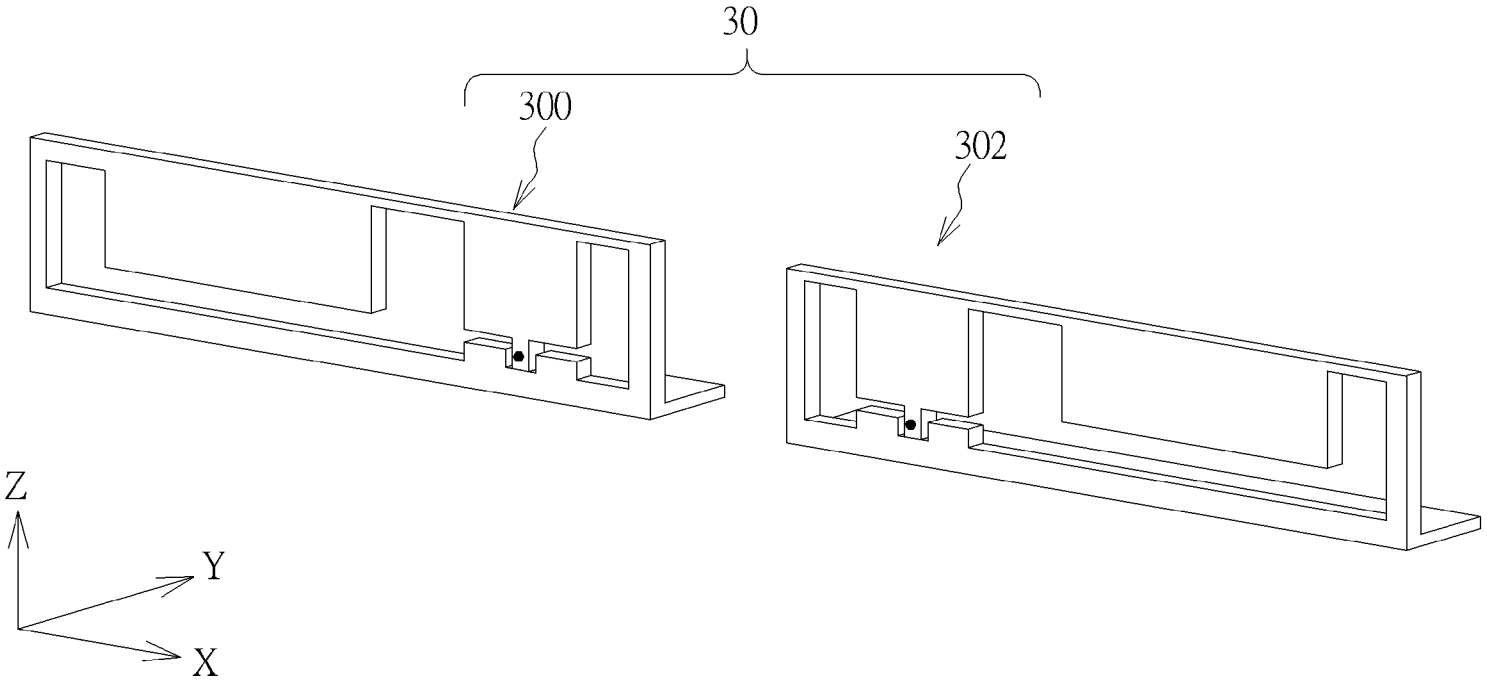
FIG. 3B is a schematic diagram of a three-dimensional view of the antenna system shown in FIG. 3A.

For example, please refer to FIGS. 3A and 3B, which are schematic diagrams of a front view (x and z axes) and a three-dimensional view (x, y and z axes) of an antenna system 30 according to an embodiment of the present invention, respectively. The antenna system 30 is composed of antennas 300 and 302. The antennas 300 and 302 have structures the same as the antenna 10 shown in FIGS. 1A and 1B. The antennas 300 and 302 are symmetrically disposed along the horizontal direction x. In such a situation, the isolation may be improved by adjusting the parasitic blocks of the antennas 300 and 302. Furthermore, please refer to FIG. 4, which is a schematic diagram of a simulation result for antenna characteristics of the antenna system 30 applied to 2.4 GHz and 5 GHz frequency bands. The dash line represents the return loss of the antenna 300, the dotted line represents the return loss of the antenna 302, and the solid line represents the isolation of the antennas 300 and 302. As can be seen from the simulation result in FIG. 4, the antennas 300 and 302 operate at dual-band, and the isolation between the two antennas 300 and 302 achieves at least 20 dB, which therefore, may effectively prevent interference between different signals and increase the radiation efficiency. Accordingly, the horizontal distance between the antennas 300 and 302 may be further decreased to suit limited space applications, such as Ultrabooks and tablet PCs.

Figure 4:
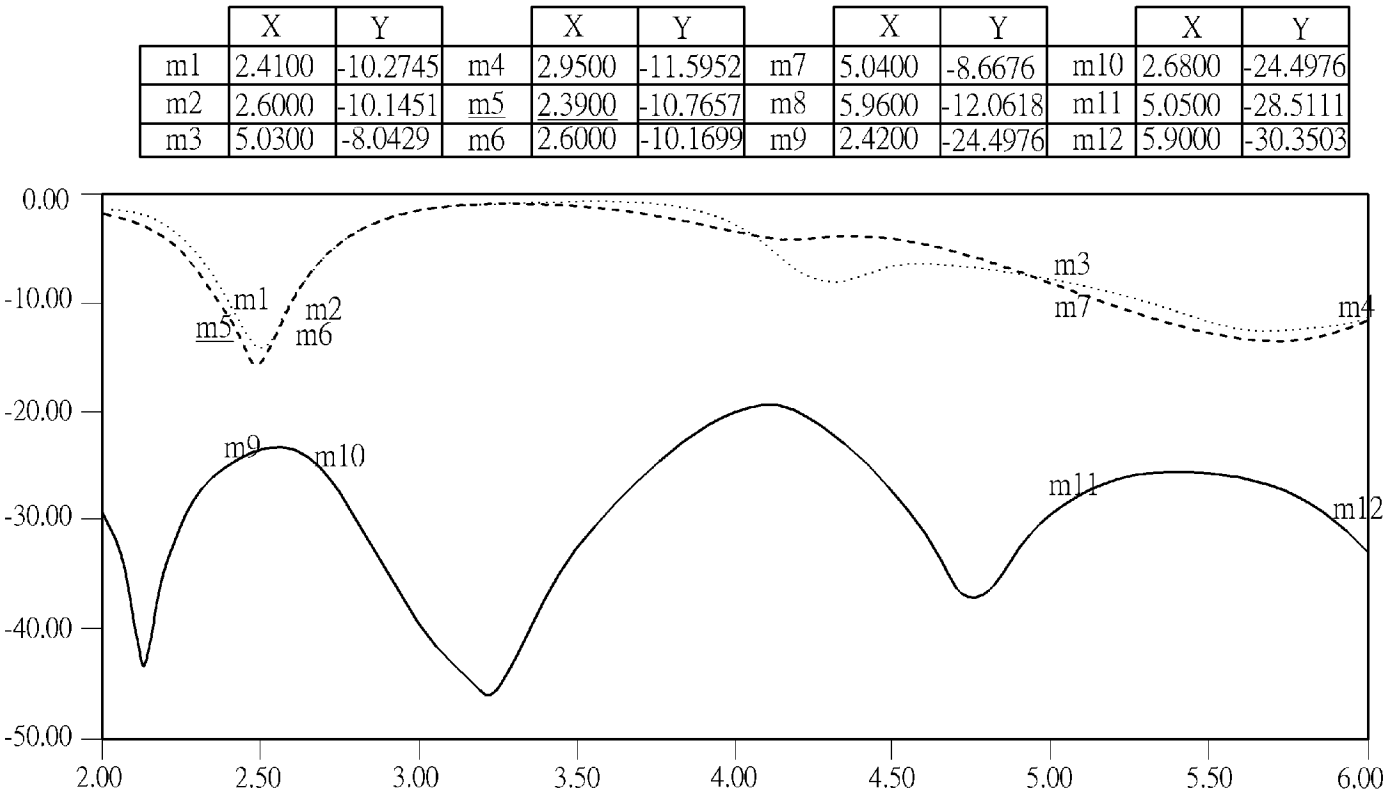
FIG. 4 shows a schematic diagram of a simulation result for antenna characteristics of the antenna system shown in FIG. 3A.
Figure 5A:
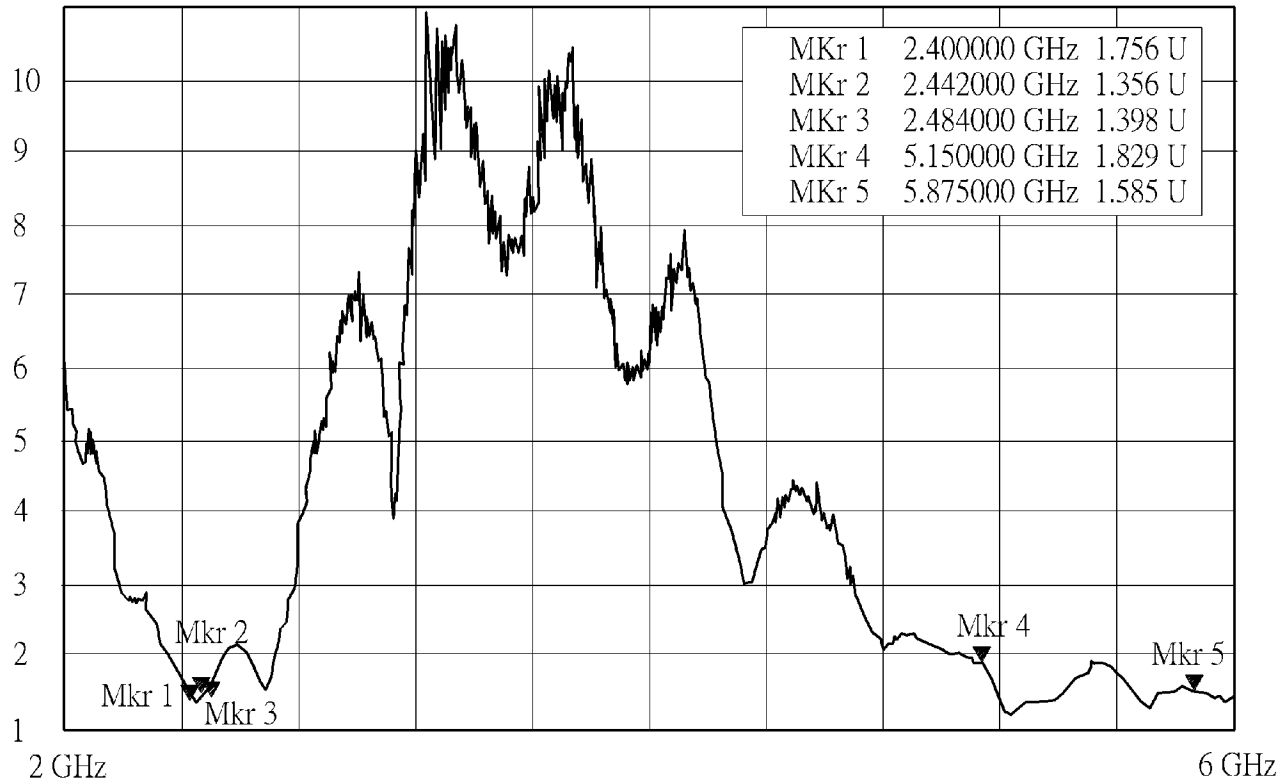
FIG. 5A shows a schematic diagram of a measurement result for voltage standing wave ratio (VSWR) of an antenna in the antenna system shown in FIG. 3A.
Figure 5B:
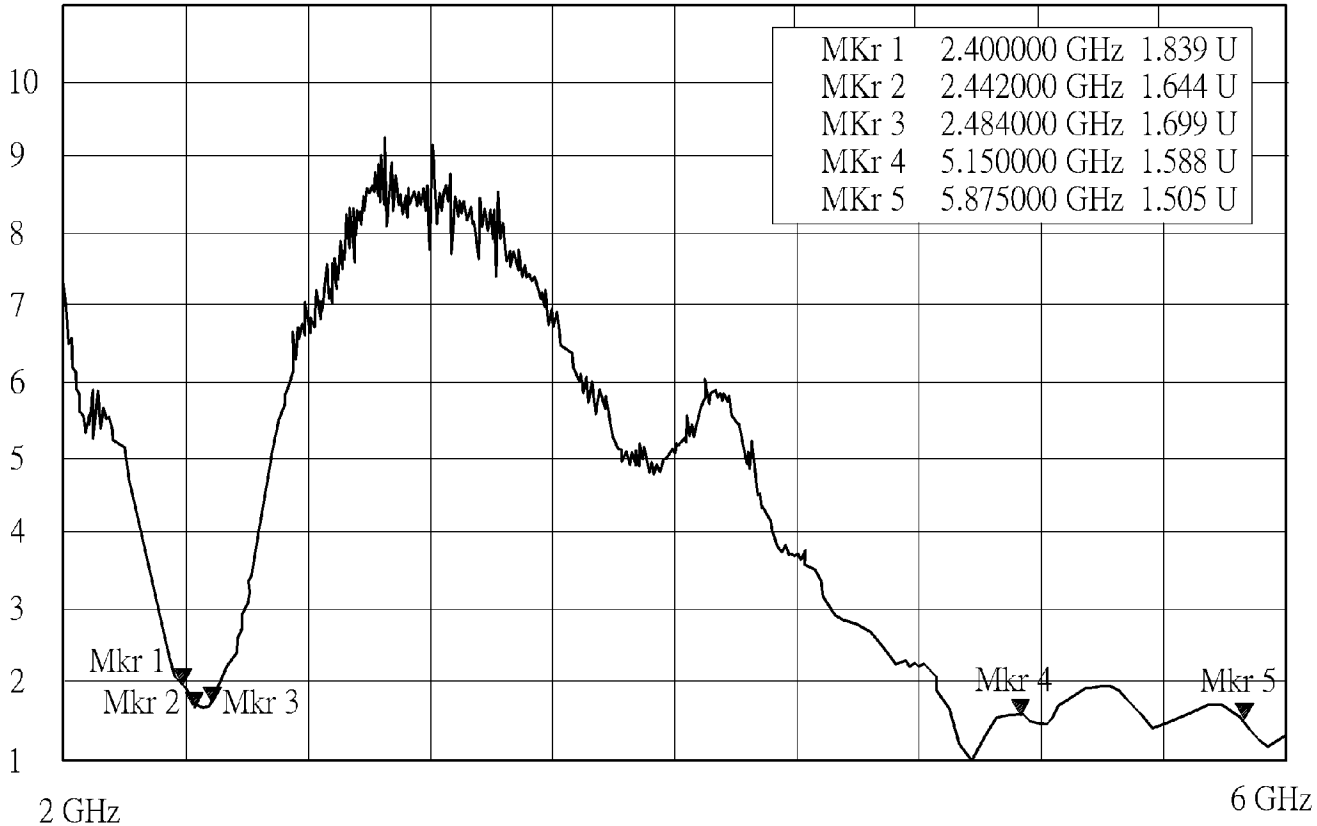
FIG. 5B shows a schematic diagram of a measurement result for VSWR of another antenna in the antenna system shown in FIG. 3A.
Figure 5C:
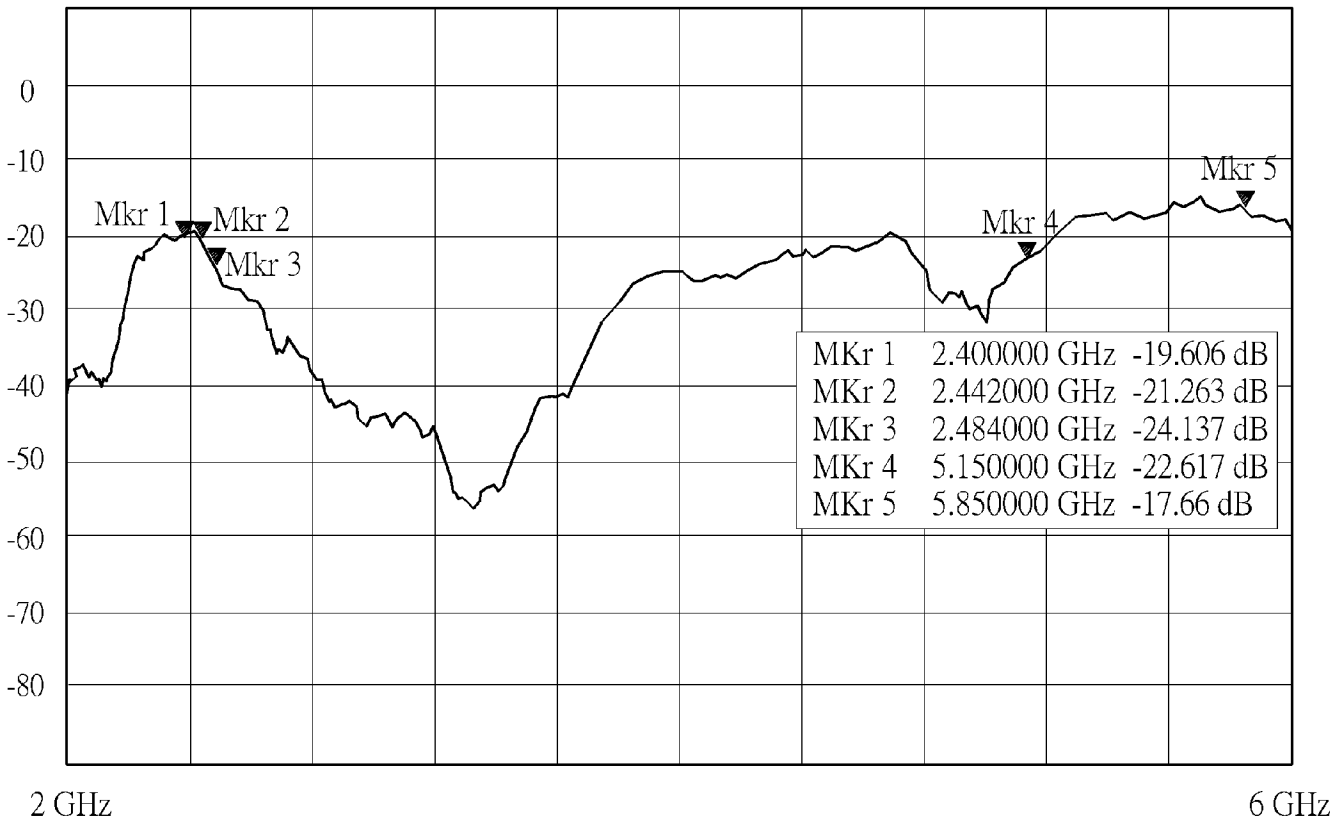
FIG. 5C shows a schematic diagram of a measurement result for isolation of the antenna system shown in FIG. 3A.
Figure 5D:
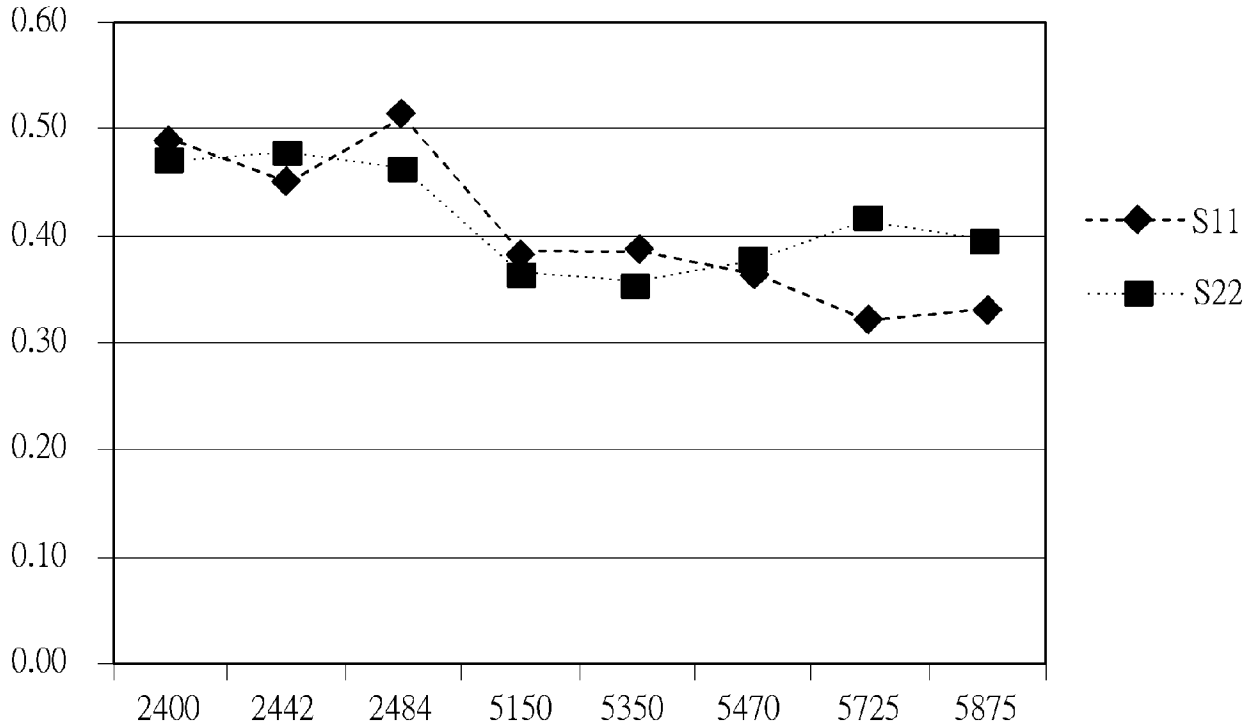
FIG. 5D shows a schematic diagram of a measurement result for antenna efficiency of the antenna system shown in FIG. 3A.

FIG. 4 is a schematic diagram of a simulation result obtained from an antenna simulator. Please further refer to FIG. 5A to FIG. 5C for measurement results for the antenna characteristics of the antenna system 30. FIG. 5A shows a schematic diagram of a measurement result for voltage standing wave ratio (VSWR) of the antenna 300, FIG. 5B shows a schematic diagram of a measurement result for VSWR of the antenna 302, and FIG. 5C shows a schematic diagram of a measurement result for isolation of the antennas 300 and 302. The dual-band characteristic of the antennas 300 and 302 is verified in FIG. 5A to FIG. 5C, and the antennas 300 and 302 maintain good isolation. Furthermore, please refer to FIG. 5D, which is a schematic diagram of a measurement result for the antenna efficiency of the antennas 300 and 302, wherein the dash line represents the antenna efficiency of the antenna 300, and the dotted line represents the antenna efficiency of the antenna 302. As can be seen from FIG. 5D, the antennas 300 and 302 have good radiation efficiency.

Figure 6A:
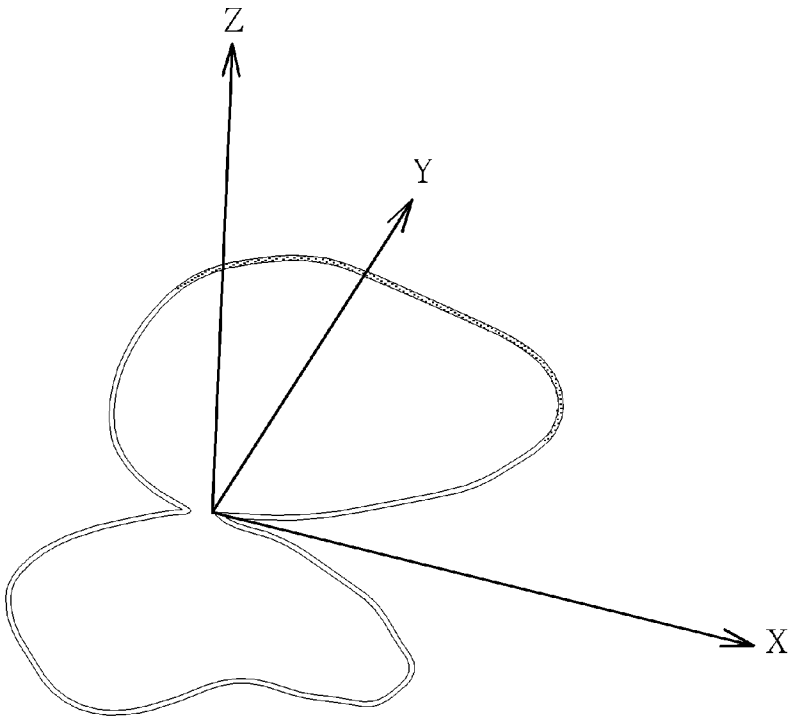
FIG. 6A, FIG. 6B and FIG. 6C are schematic diagrams of simulated three-dimensional antenna patterns when applying the antenna system shown in FIG. 3A at a low frequency band.
Figure 6B:
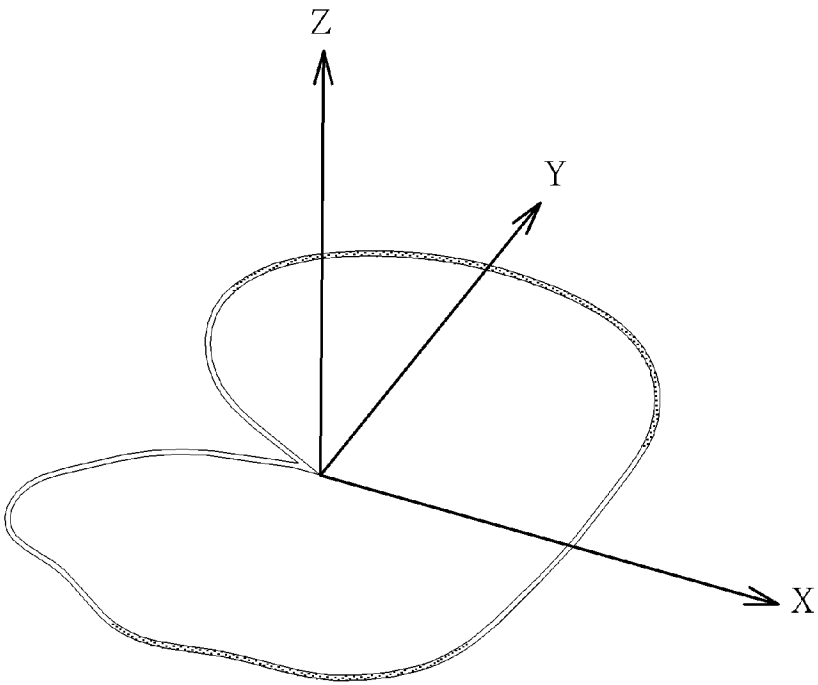
Figure 6C:
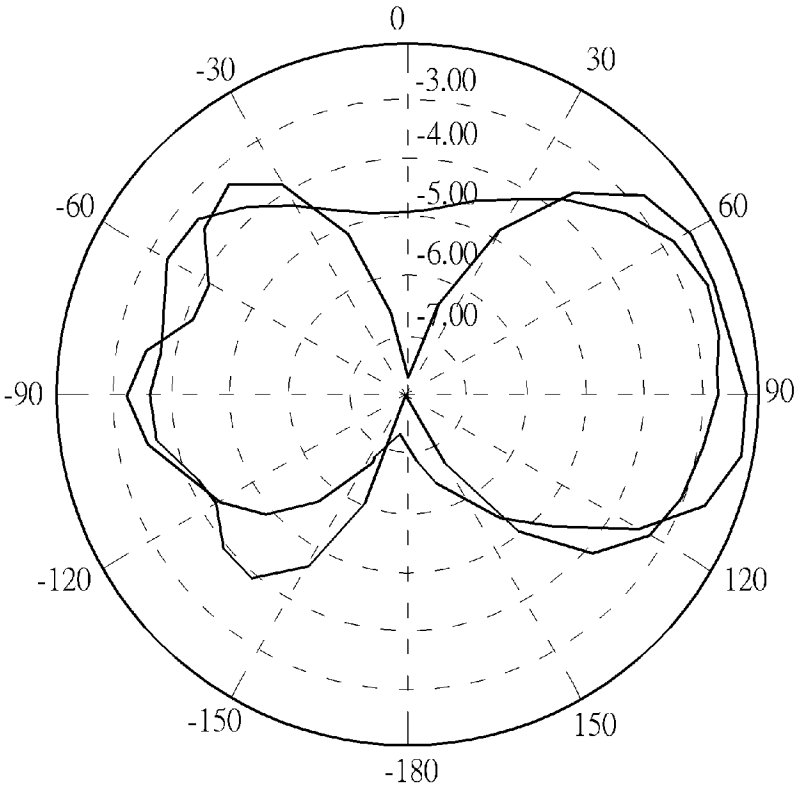
Figure 7A:
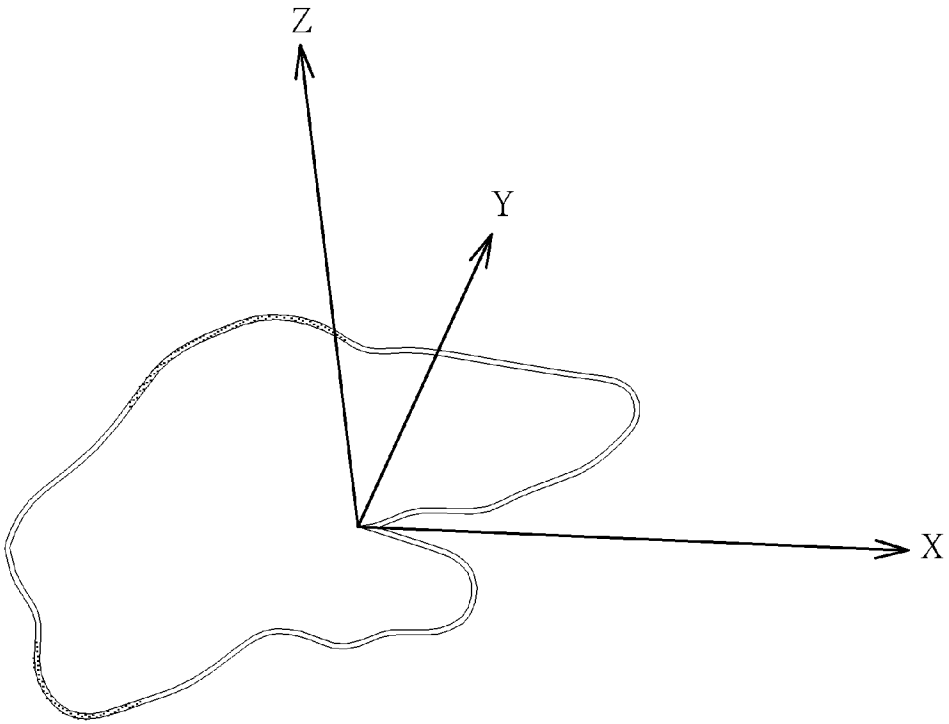
FIG. 7A, FIG. 7B and FIG. 7C are schematic diagrams of simulated antenna patterns in three-dimensional forms when applying the antenna system shown in FIG. 3A at a high frequency band.
Figure 7B:
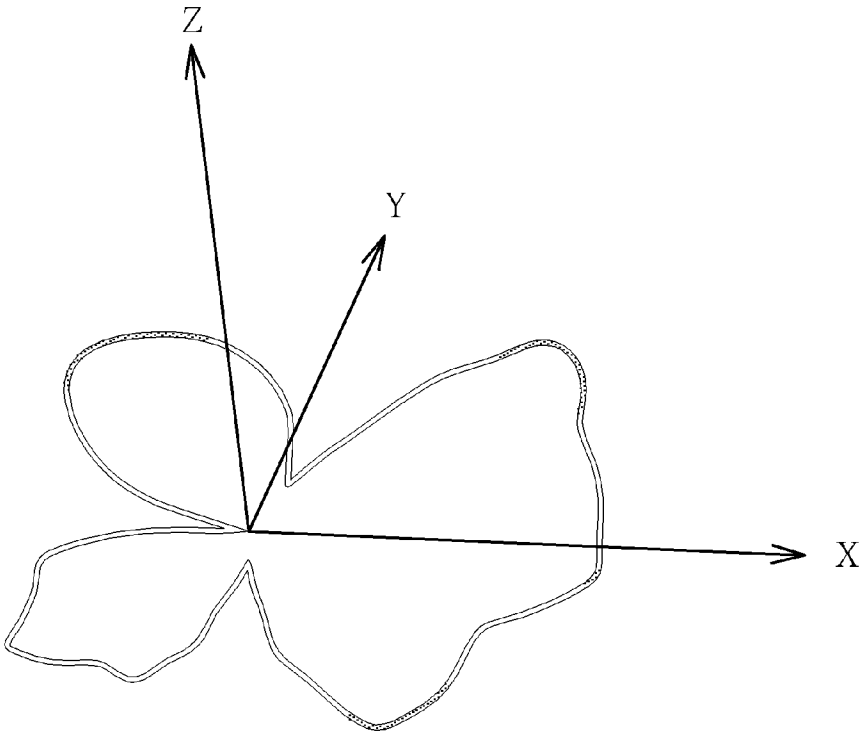
Figure 7C:
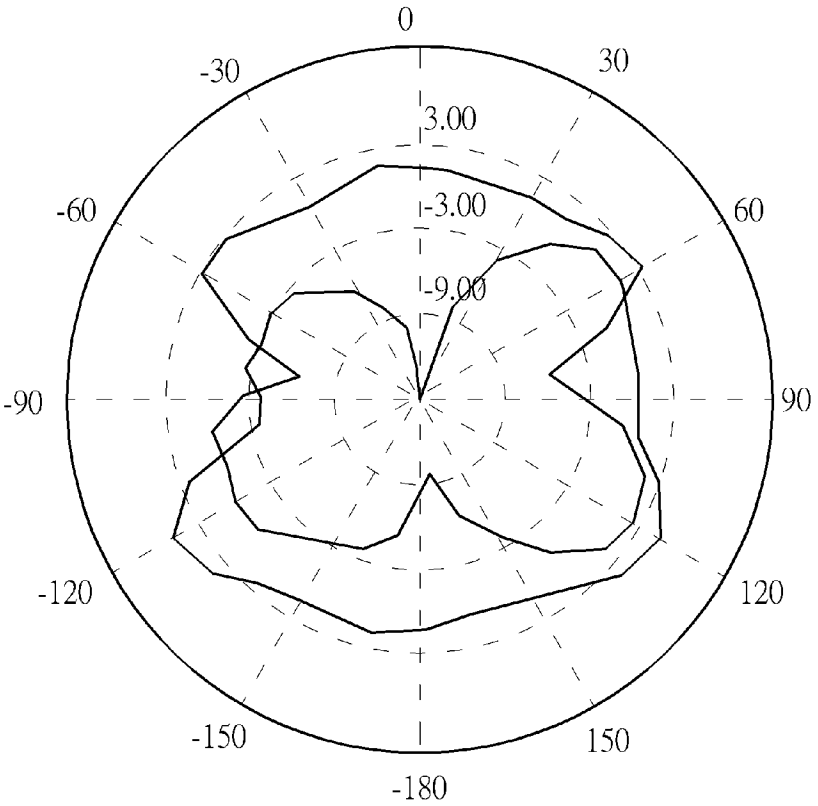

Besides, please refer to FIGS. 6A to 6C and FIGS. 7A to 7C. FIG. 6A is a schematic diagram of a simulated antenna pattern of the antenna 300 in a three-dimensional form when the antenna system 30 is applied at 2.4 GHz frequency band, FIG. 6B is a schematic diagram of a simulated antenna pattern of the antenna 302 in a three-dimensional form when the antenna system 30 is applied at 2.4 GHz frequency band, FIG. 6C is a schematic diagram of a simulated antenna pattern in a planar form when the antenna system 30 is applied at 2.4 GHz frequency band, FIG. 7A is a schematic diagram of a simulated antenna pattern of the antenna 300 in a three-dimensional form when the antenna system 30 is applied at 5 GHz frequency band, FIG. 7B is a schematic diagram of a simulated antenna pattern of the antenna 302 in a three-dimensional form when the antenna system 30 is applied at 5 GHz frequency band, and FIG. 7C is a schematic diagram of a simulated antenna pattern in a planar form when the antenna system 30 is applied at 5 GHz frequency band. As can be seen from FIGS. 6A to 6C and FIGS. 7A to 7C, the radiation patterns of the antennas 300 and 302 are only slightly overlapped, and therefore, the isolation is increased.

Note that, the antenna 10 or the antenna system 30 utilizes the parasitic blocks to change the current distribution, so as to adjust the operating frequency, the radiation pattern, the isolation, etc. Those skilled in the art can make alterations and/or modifications accordingly to adjust the number or styles of the parasitic blocks. Besides, in the antenna 10 (or the antennas 300 and 302), the first radiating element 14 and the second radiating element 16 are extended toward opposite directions (e.g., in FIG. 1A, the first radiating element 14 is extended leftward from the connecting unit 12, while the second radiating element 16 is extended rightward from the connecting unit 12). Nevertheless, the first radiating element 14 and the second radiating element 16 may be realized by other forms.

Figure 8:
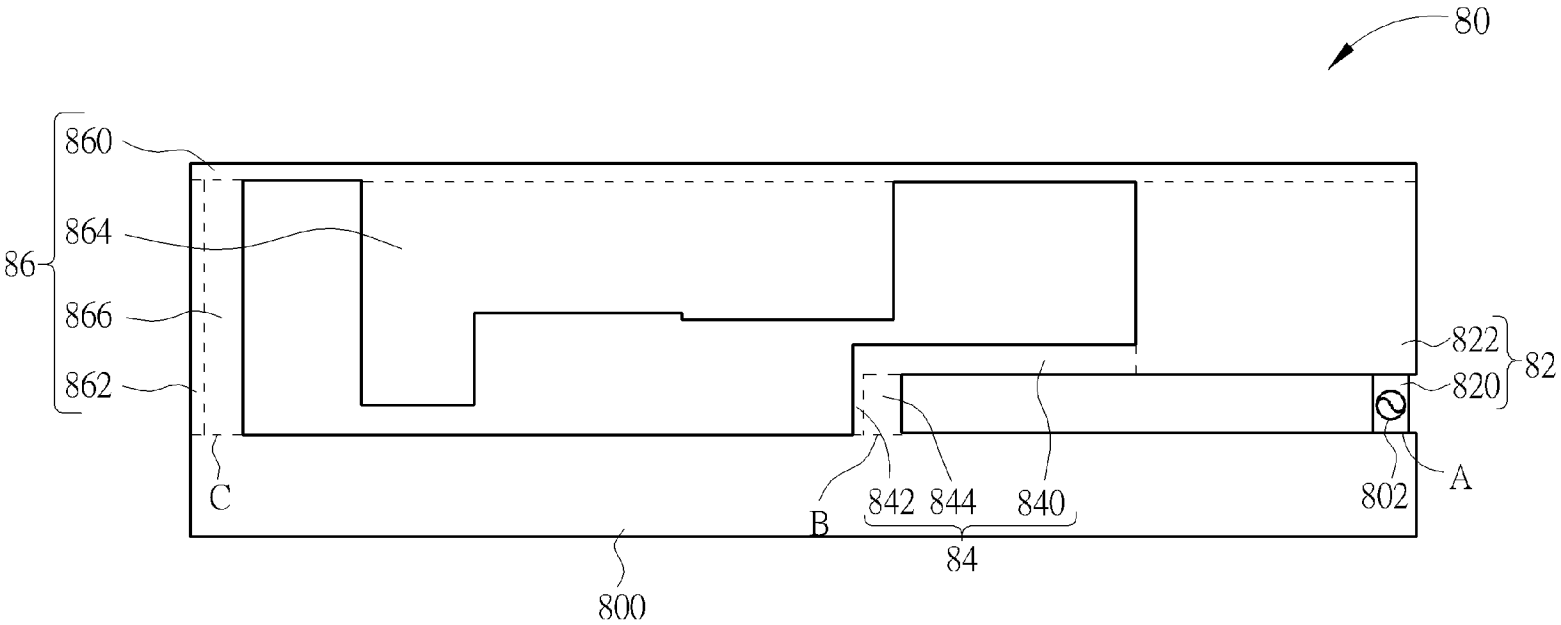
FIG. 8 is a schematic diagram of an antenna according to an embodiment of the present invention.

For example, please refer to FIG. 8, which is a schematic diagram of an antenna 80 according to an embodiment of the present invention. The structure of the antenna 80 is similar to that of the antenna 10 shown in FIGS. 1A and 1B. The antenna 80 may also transmit and receive the radio signal RF_1 at the first frequency band and the radio signal RF_2 at the second frequency band, such as radio signals of 5 GHz and 2.4 GHz, and has good radiation efficiency and adjustable radiation pattern. In detail, the antenna 80 is made of a conductive material (e.g., metal such as iron and copper), and includes a grounding unit 800, a feeding terminal 802, a connecting unit 82, a first radiating element 84 and a second radiating element 86. The grounding unit 800 is used for providing grounding. The connecting unit 82 is electrically connected to a first terminal (denoted by A) of the grounding unit 100, and may be viewed as composing of a first block 820 and a second block 822, wherein the feeding terminal 802 is formed on the first block 820 for transmitting radio signals. The first radiating element 84 is electrically connected to the second block 822 of the connecting unit 82, and is extended to a second terminal (denoted by B) of the grounding unit 800. A length of a signal path from the feeding terminal 802 through the connecting unit 82 and the first radiating element 84 to the second terminal B of the grounding unit 800 is substantially equal to a half wavelength of the radio signal RF_1 at the first frequency band, in order to form a first radiating element used for transmitting and receiving the radio signal RF_1 at the first frequency band. Similarly, the second radiating element 86 is electrically connected to the second block 822 of the connecting unit 82, and is extended to a third terminal (denoted by C) of the grounding unit 800. A length of a signal path from the feeding terminal 802 through the connecting unit 82 and the second radiating element 86 to the third terminal C of the grounding unit 800 is substantially equal to a half wavelength of the radio signal RF_2 at the second frequency band, in order to form a second radiating element used for transmitting and receiving the radio signal RF_2 at the second frequency band. In addition, the first radiating element 84 includes a first branch 840, a second branch 842 and a parasitic block 844. The first branch 840 is substantially perpendicular to the second branch 842. The parasitic block 844 is extended from the second branch 842 toward the connecting unit 82, and is connected with the first branch 840 and the second terminal B of the grounding unit 800. Similarly, the second radiating element 86 includes a third branch 860, a fourth branch 862 and parasitic blocks 864 and 866. The third branch 860 is substantially perpendicular to the fourth branch 862. The parasitic block 864 is extended from the third branch 860 toward the grounding unit 800. The parasitic block 866 is extended from the fourth branch 862 toward the connecting unit 82, and is connected with the third branch 860 and the third terminal C of the grounding unit 800.

As can be seen by comparing FIG. 8 with FIG. 1A, the styles of the parasitic blocks are different, and the first radiating element 84 and the second radiating element 86 of the antenna 80 are both extended from the connecting unit 82 toward the left side of FIG. 8, which also conforms to the concept of the present invention.

On the other hand, in the above-mentioned embodiments, the grounding unit is utilized for providing signal grounding. When applying to a wireless communication device, the grounding unit may be further connected with a system grounding element for enhancing the grounding effect for current on the radiating element, so as to reduce required areas for disposing the antennas.

Figure 9A:
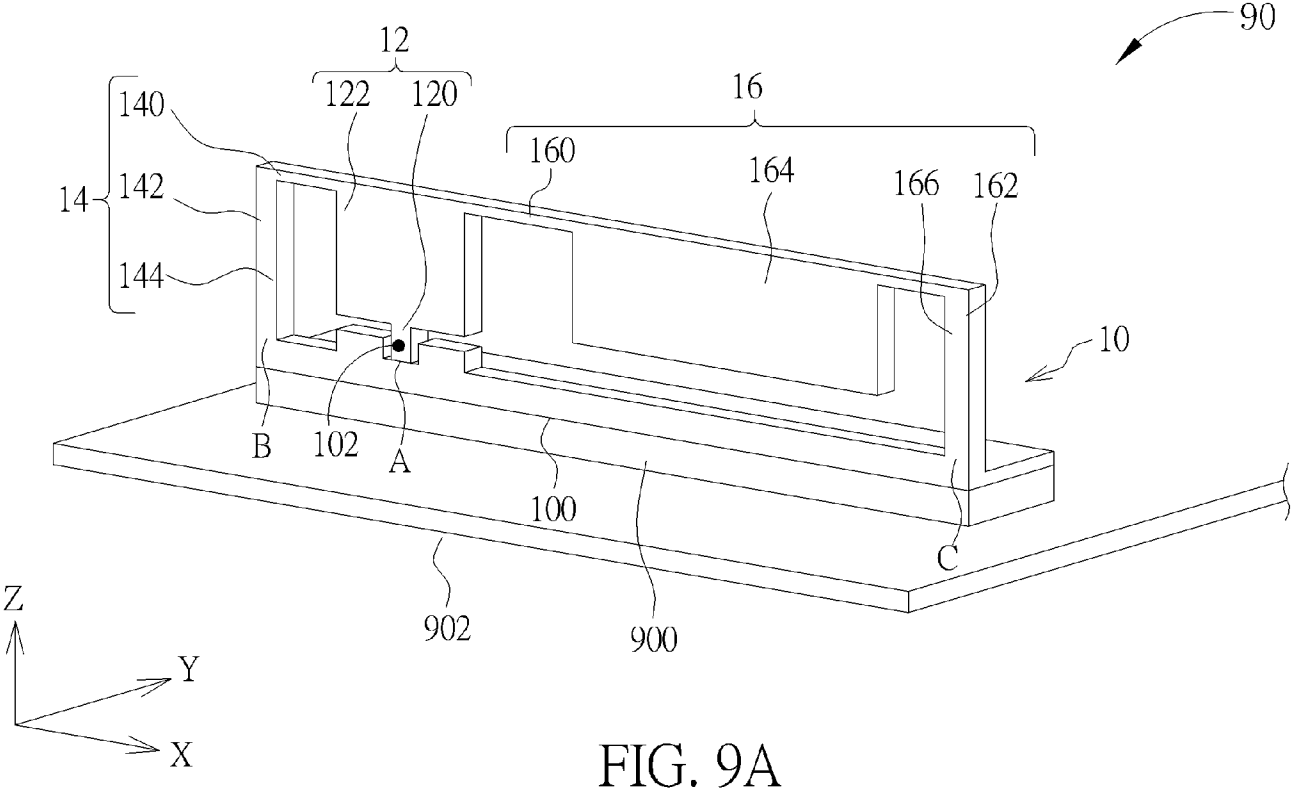
FIGS. 9A, 9B, and 9C are schematic diagrams of assembly, lateral view and exploded view of an antenna device according to an embodiment of the present invention, respectively.
Figure 9B:
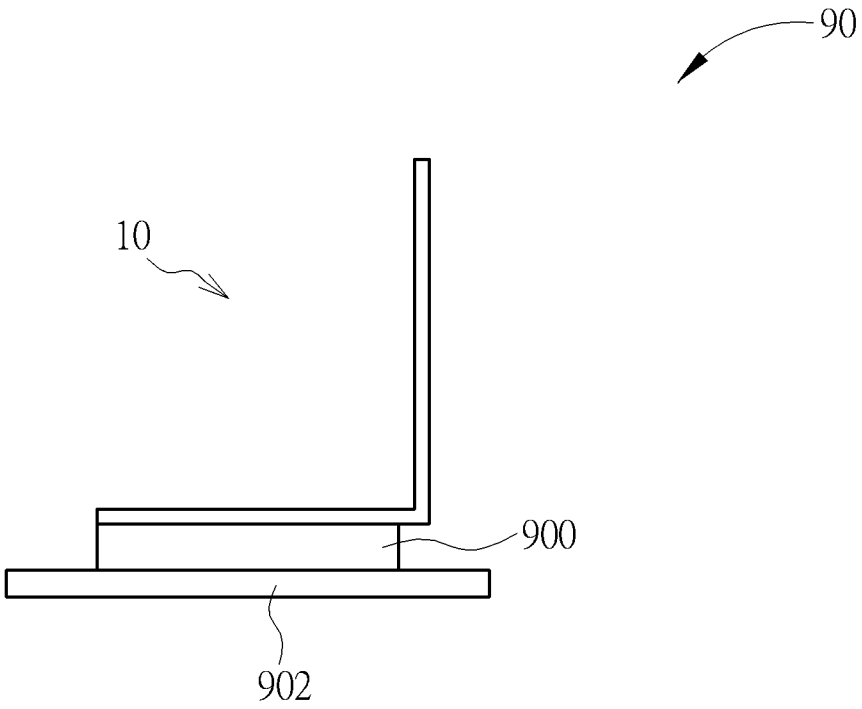
Figure 9C:
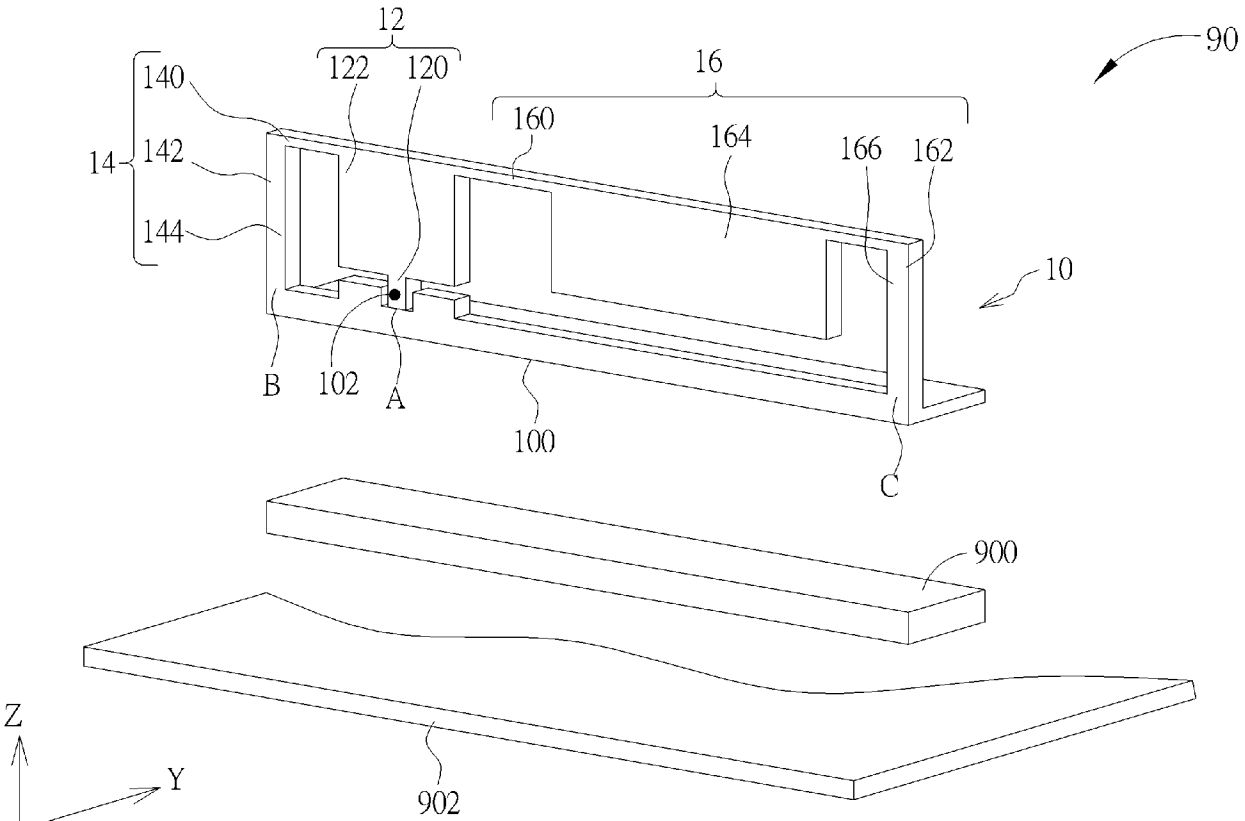
Figure 9D:
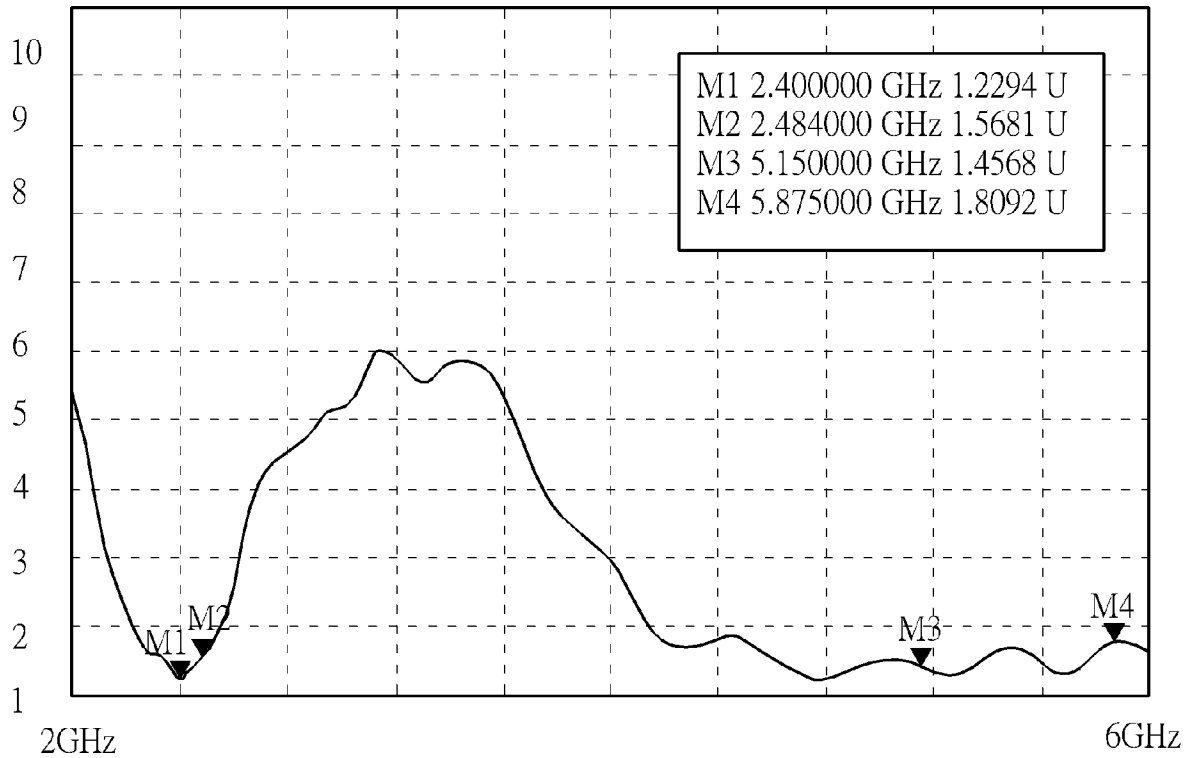
FIG. 9D is a schematic diagram of VSWR of the antenna device shown in FIG. 9A.

For example, please refer to FIGS. 9A, 9B and 9C, which are schematic diagrams of assembly, lateral view and exploded view of an antenna device 90 according to an embodiment of the present invention. The antenna device 90 is used in a wireless communication device, and is realized by electrically connecting the antenna 10 shown in FIGS. 1A and 1B to a system grounding element 902 of the wireless communication device via a connecting component 900. As a result, the current may be directly grounded so as to effectively reduce the area required for disposing the antenna 10. The VSWR of the antenna device 90 is shown in FIG. 9D.

By the same token, the antenna system 30 shown in FIGS. 3A and 3B may be connected with a system grounding element of the wireless communication device via a connecting component. For example, please refer to FIGS. 10A, 10B and 10C, which are schematic diagrams of assembly, lateral view and exploded view of an antenna device 110 according to an embodiment of the present invention, respectively. The antenna device 110 is realized by electrically connecting the antenna system 30 shown in FIGS. 3A and 3B to a system grounding element 1102 of the wireless communication device via a connecting component 1100. As a result, the current may be directly grounded so as to effectively reduce the area required for disposing the antenna system 30. The VSWR of the antenna device 110 is shown in FIG. 10D.

Figure 10A:
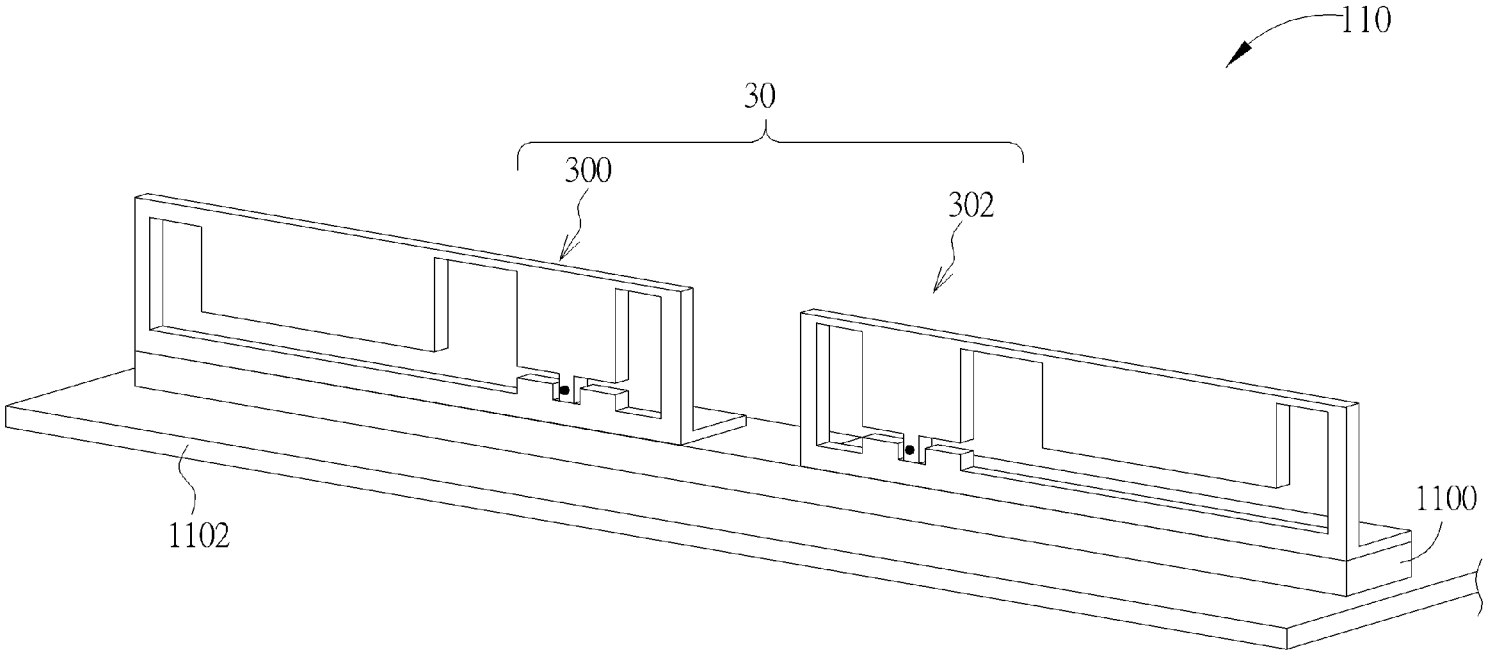
FIGS. 10A, 10B, and 10C are schematic diagrams of assembly, lateral view and exploded view of an antenna device according to an embodiment of the present invention, respectively.
Figure 10B:
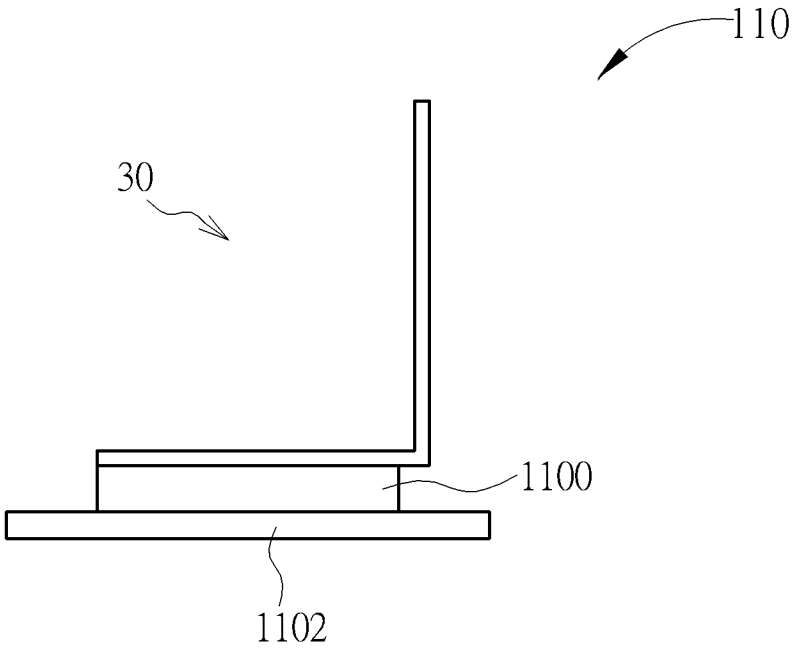
Figure 10C:
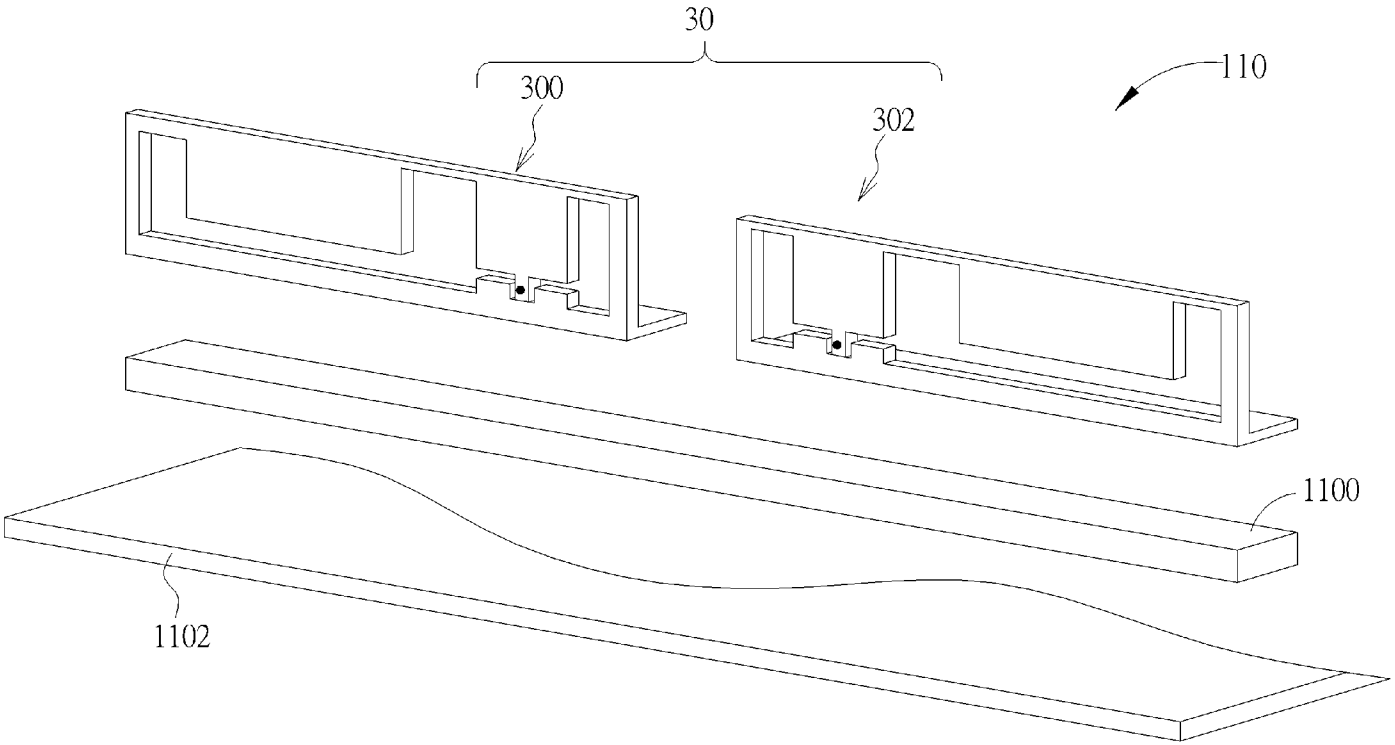
Figure 10D:
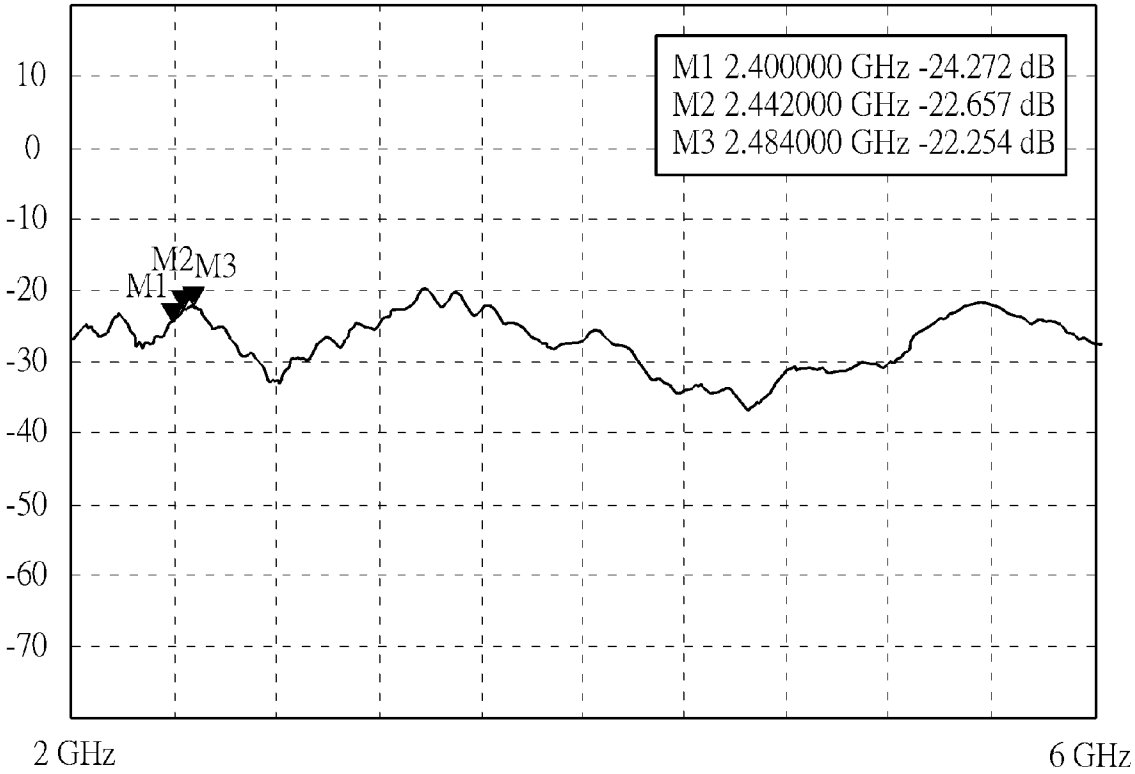
FIG. 10D is a schematic diagram of VSWR of the antenna device shown in FIG. 10A.

The antenna device 90 shown in FIGS. 9A to 9C or the antenna device 110 shown in FIGS. 10A to 10C are realized by electrically connecting the antenna 10 or the antenna system 30 with the system grounding element 902 or 1102 via the connecting component 900 or 1100, so as to reduce the required areas by directly grounding the currents. The connecting components 900 and 1100 may be made of a conductive cushioning material (e.g., conductive foam, conductive sponge or conductive fabric) or a conductive metal (e.g., copper foil, aluminum foil, etc.). The system grounding elements 902 and 1102 may be a grounding structure (or a grounding plate) of a liquid crystal display (LCD) screen in a laptop or a tablet PC, or a grounding part of a mainframe depending on different applications. Structures or materials capable of providing a system grounding effect may also be used to realize the system grounding elements 902 and 1102, and should not be limited herein.

Note that, dual-band operations are illustrated as examples for the above-mentioned embodiments. However, since the current distribution of the antennas of the present invention may be adjusted or changed by using the parasitic blocks, it is to achieve multi-band or wide-band operations but not limited to dual-band applications. For example, dimensions, locations, and distances from the connecting unit or other components may be adjusted to change the coupling amount of the parasitic blocks, so as to transmit and receive radio signals at a frequency band other than the first frequency band and the second frequency band. These alterations and modifications should be within the scope of the present invention.

To sum up, current distribution of the antennas according to various embodiments of the present invention may be changed or adjusted by using the parasitic blocks, so as to control the radiation pattern or the operating frequency bands, or to control the isolation when multiple antennas are juxtaposed. Thus, the antennas according to various embodiments of the present invention provide design flexibility such that the radiation pattern and the operating frequency bands thereof may be effectively adjusted, and thereby adapting to different applications with increased or enhanced antenna efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna for transmitting and receiving radio signals of at least a first frequency band and a second frequency band, comprising:

a grounding unit, for providing grounding;

a connecting unit, electrically connected to a first terminal of the grounding unit;

a feeding terminal, formed on the connecting unit, for transmitting the radio signals of the first frequency band and the second frequency band;

a first radiating element, electrically connected to the connecting unit and a second terminal of the grounding unit, wherein a length of a signal path from the feeding terminal through the connecting unit and the first radiating element to the second terminal of the grounding unit is substantially equal to a half wavelength of radio signals at the first frequency band, to form the first radiating element used for transmitting and receiving the radio signals of the first frequency band; and a second radiating element, electrically connected to the connecting unit and a third terminal of the grounding unit, wherein a length of a signal path from the feeding terminal through the connecting unit and the second radiating element to the third terminal of the grounding unit is substantially equal to a half wavelength of radio signals at the second frequency band, to form the second radiating element used for transmitting and receiving the radio signals of the second frequency band.

2. The antenna of claim 1, wherein the first radiating element comprises:

a first branch, electrically connected to the connecting unit; and a second branch, electrically connected to the first branch and the second terminal of the grounding unit;

wherein the first branch is substantially perpendicular to the second branch.

3. The antenna of claim 2, wherein the first radiating element further comprises at least one parasitic block formed on the first branch or the second branch, for adjusting a transmitting and receiving frequency band of the first radiating element.

4. The antenna of claim 3, wherein the at least one parasitic block of the first radiating element adjusts the transmitting and receiving band of the first radiating element, to transmit and receive radio signals beyond the first frequency band and the second frequency band.

5. The antenna of claim 1, wherein the second radiating element comprises:

a third branch, electrically connected to the connecting unit; and a fourth branch, electrically connected to the third branch and the third terminal of the grounding unit;

wherein the third branch is substantially perpendicular to the fourth branch.

6. The antenna of claim 5, wherein the second radiating element further comprises at least one parasitic block formed on the third branch or the fourth branch, for adjusting a transmitting and receiving frequency band of the second radiating element.

7. The antenna of claim 6, wherein the at least one parasitic block of the second radiating element adjusts the transmitting and receiving frequency band of the second radiating element, to transmit and receive radio signals beyond the first frequency band and the second frequency band.

8. The antenna of claim 1, wherein the first radiating element is substantially extended from the connecting unit toward a first direction, and the second radiating element is substantially extended from the connecting unit toward a second direction.

9. The antenna of claim 8, wherein the first direction is substantially opposite to the second direction.

10. The antenna of claim 8, wherein the first direction is substantially parallel to the second direction.

11. The antenna of claim 1, wherein the connecting unit comprises:

a first block, electrically connected to the first terminal of the grounding unit; and a second block, electrically connected to the first block, the first radiating element and the second radiating element;

wherein an area of the first block is smaller than that of the second block, and the feeding terminal is formed on the first block.

12. The antenna of claim 1, wherein the grounding unit comprises at least one parasitic block.

13. The antenna of claim 1, being made of a conductive material.

* * * * *